US009427066B2

(12) United States Patent
Davidson

(10) Patent No.: US 9,427,066 B2
(45) Date of Patent: Aug. 30, 2016

(54) STAND FOR WIGS

(71) Applicant: Gloria Davidson, Cedarhurst, NY (US)

(72) Inventor: Gloria Davidson, Cedarhurst, NY (US)

( * ) Notice: Subject to any disclaimer, the term of this patent is extended or adjusted under 35 U.S.C. 154(b) by 0 days.

(21) Appl. No.: 14/623,645

(22) Filed: Feb. 17, 2015

(65) Prior Publication Data

US 2015/0230589 A1 Aug. 20, 2015

Related U.S. Application Data

(60) Provisional application No. 61/940,538, filed on Feb. 17, 2014.

(51) Int. Cl.

| | |
|---|---|
| ***A45D 44/14*** | (2006.01) |
| ***A41H 5/00*** | (2006.01) |
| ***A41G 3/00*** | (2006.01) |
| *A47F 7/06* | (2006.01) |

(52) U.S. Cl.

CPC ..... *A45D 44/14* (2013.01); *A41G 3/0041* (2013.01); *A41H 5/00* (2013.01); *A47F 7/065* (2013.01)

(58) Field of Classification Search

CPC ..... A45D 8/00; A45D 8/38; A45D 44/14; A47F 8/00; A47F 8/02; A47F 7/06; A41H 5/00; A41G 3/0041; A41G 3/0058

USPC ..... D20/10; D28/93

See application file for complete search history.

(56) References Cited

U.S. PATENT DOCUMENTS

| | | | | | |
|---|---|---|---|---|---|
| 1,746,487 | A * | 2/1930 | Martin | A47G 25/10 | 211/196 |
| 3,515,318 | A * | 6/1970 | Preble | A45D 44/14 | 206/8 |
| 3,658,283 | A * | 4/1972 | Martin | A45D 44/14 | 223/66 |
| 3,661,270 | A * | 5/1972 | Lucci | A47G 25/00 | 211/205 |
| 3,779,433 | A * | 12/1973 | Imai | A45D 44/14 | 223/66 |
| 4,470,527 | A * | 9/1984 | Middleton | F16B 7/10 | 223/66 |
| 5,503,312 | A | 4/1996 | Kassner | | |
| 6,578,716 | B1 * | 6/2003 | Wei | A47F 7/06 | 206/9 |

* cited by examiner

*Primary Examiner* — Ismael Izaguirre
(74) *Attorney, Agent, or Firm* — Power Del Valle LLP; Marguerite Del Valle

(57) ABSTRACT

A stand for holding at least one wig having a base where one or more dowels may be stacked thereon to hold a dome upon which a wig may be placed, and in which base the dowels and dome may be stored for storage or transport.

11 Claims, 8 Drawing Sheets

STAND FOR WIGS

FIELD OF THE INVENTION

The present invention relates to a varying height device for holding wigs which can be disassembled and the pieces stored in a compact, transportable configuration.

BACKGROUND OF THE INVENTION

Styrofoam wig heads are commonly used to hold wigs. These styrofoam heads, however, are very light and are prone to toppling. When the styrofoam heads fall, the wigs may fall onto the floor or into items that are normally kept in the vicinity of wigs, such as make-up, creams, clothing, or grooming implements. In such an event, the wig may become damaged or the style disheveled. It is thus desirable to anchor the wig head into place for the protection and preservation of the wig.

The prior art discloses a number of different devices to hold and store wigs to protect them and keep them neat and styled for the next time they are used.

U.S. Pat. No. 5,503,312 to Kassner for a "Portable-Travel-Storage-Styling Wig Case" discloses a cage structure with a pivoting neck lever connected to a head form. The lever enables the user to pivot the head outside the cage for styling, and pivot back into the cage for storage. The device can accommodate only one wig and is unwieldy, unattractive, and requires that the user pivot the head form into an upside-down position and then invert the entire device so that the head form is upright and able to receive and hold a wig in place.

A wig/hairpiece block stand is currently available commercially from MHRW International. This product consists of a thin flat base having an elongated peg extending therefrom and configured to hold a styrofoam wig head. Although it is advertised as a "non-topple" product, the base is of only a relatively small area. Because the center of gravity of the device, while it is holding a wig, is quite high, the stability of these devices is limited. The entire assembly, including the wig, will topple and become subject to damage when entirely predictable minor forces are applied to them, for example, being hit by an elbow BaronUnlimited.com sells a styrofoam wig head with a detachable suction stand to hold it to the table. The wig cannot be turned or manipulated while it is on this product, thus eliminating this stand for styling purposes.

People also use clamps to attach a wig head to a wall, shelf, or countertop. Clamping the wig head will also limit the amount of manipulation that can be used to style the wig.

Many people who use wigs own two or even more. None of the prior art devices disclose a storage and holding system for multiple wigs.

The present invention addresses and corrects the disadvantages of prior art devices. Moreover, the present invention discloses an apparatus that may be easily disassembled and reassembled for traveling.

SUMMARY OF THE INVENTION

The present invention is a stand for holding and storing one or more wigs. The stable base and dowels elevate the wig to isolate and protect it, while leaving it open to ventilation and easily manipulated for two-handed styling. The stand is easily disassembled and reassembled and all parts fit together for easy and compact transport.

The wig stand of the present invention consists of a base, a number of stacking, interlocking dowels, and a dome. A first dowel is fit onto the base and additional identical dowels may be stacked thereon to increase the height of the stand to accommodate longer length wigs. The dome is then fit on the end of the topmost dowel to receive a wig for display, storage, or styling. The wig stand can be easily disassembled and the dowels and dome fit compactly into the base for travel or storage.

Wig owners who own more than one wig have had to purchase multiple individual styrofoam wig heads. This creates opportunity for clutter and contributes to the disorganization that might result in the toppling of a stored wig. In contrast, the invention of the present application may be configured to provide storage capacity for multiple wigs, appropriately spaced apart, so that each wig is protected from tangling with another wig and also allows room between the stored wigs so that the owner may easily style and maintain her wigs.

DETAILED DESCRIPTION OF THE INVENTION

Figure 1:
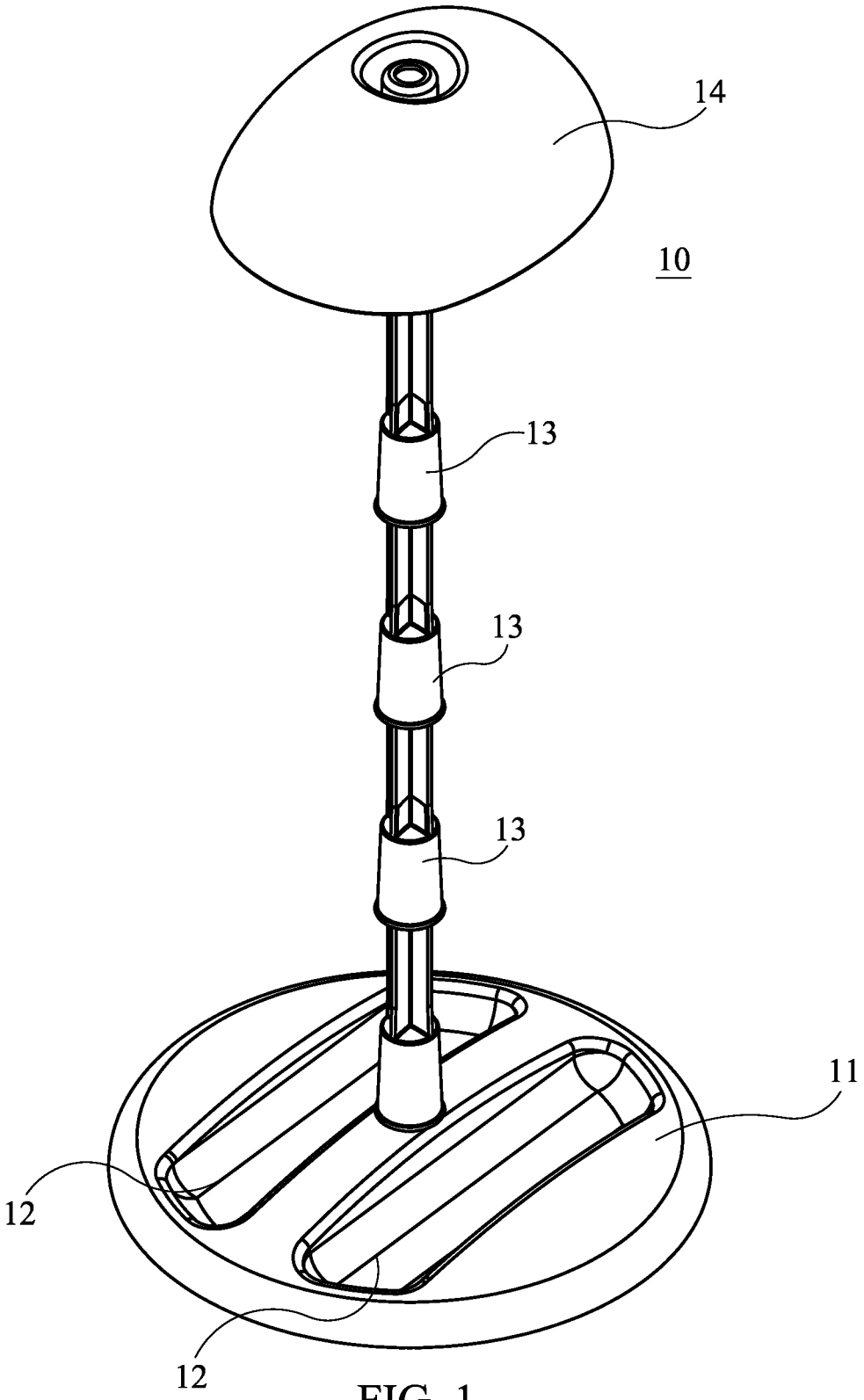
FIG. 1 is a perspective view of a uni-head embodiment of the present invention as assembled.

An embodiment of the inventive device 10, shown assembled in FIG. 1, consists of a base 11 having indentations 12 therein. Connected to base 11 is at least one dowel 13. Dowels 13 can be stacked to increase the height of the stand so as to accommodate wigs of longer length hair. Attached to the uppermost dowel 13 is a dome 14 on which a wig (not shown) is placed where it can be styled, displayed, or stored.

Figure 2:
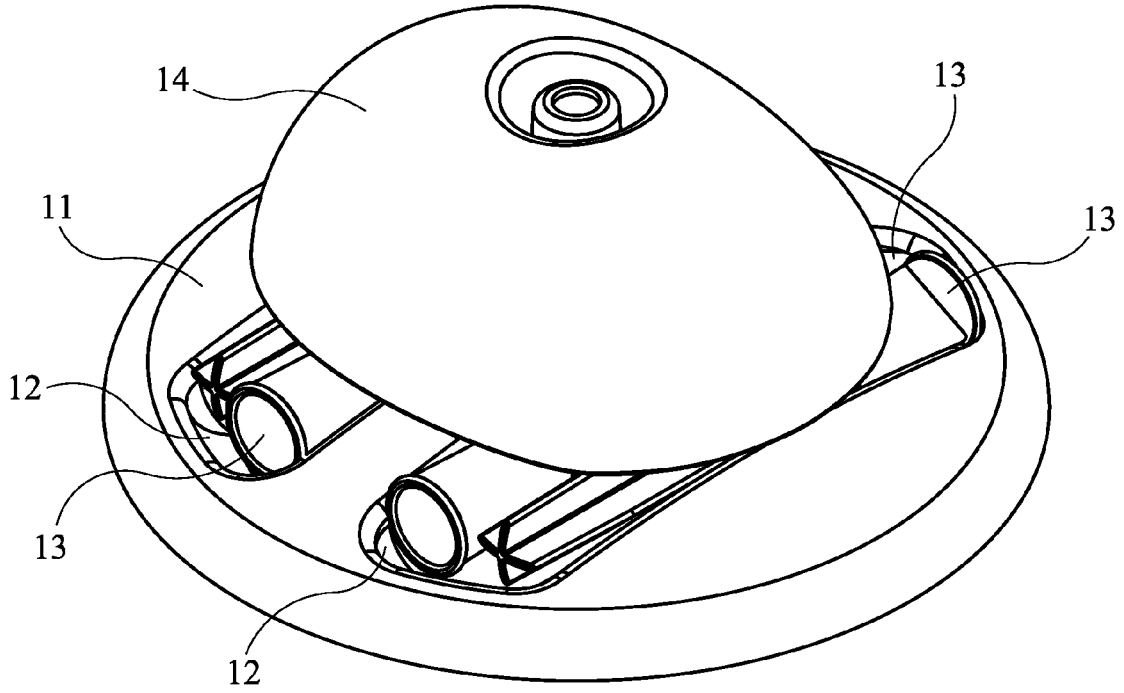
FIG. 2 is a perspective view of a disassembled unihead, with the dowels and dome of the device stored in the base.

Device 10 can be disassembled for storage or transport, as shown in FIG. 2. Dowels 13 are nested into indentations 12 and dome 14 is secured to base 11, partly covering and thus maintaining dowels 13 in place.

Figure 3:
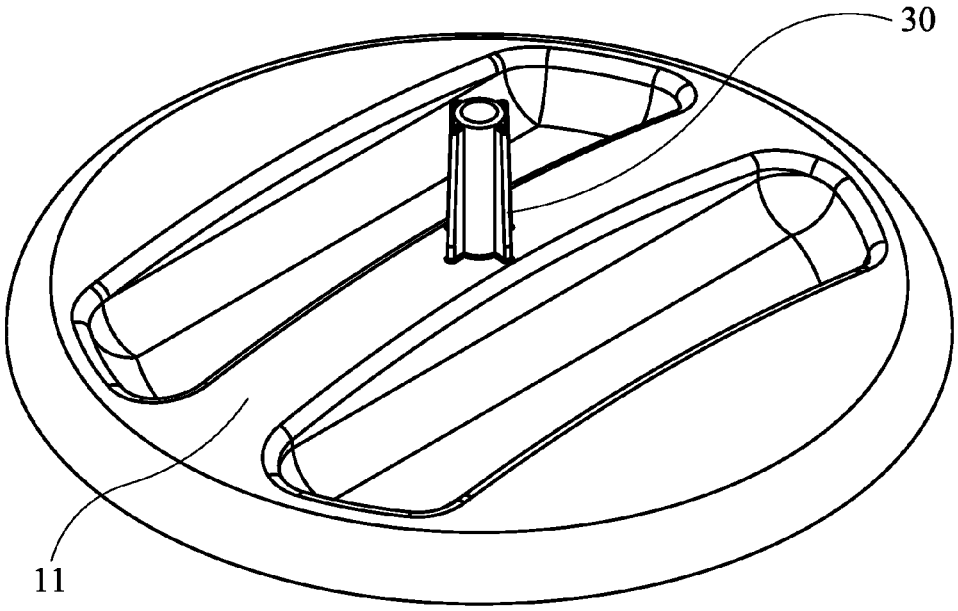
FIG. 3 is a perspective view of a base of a uni-head embodiment.
Figure 4A:
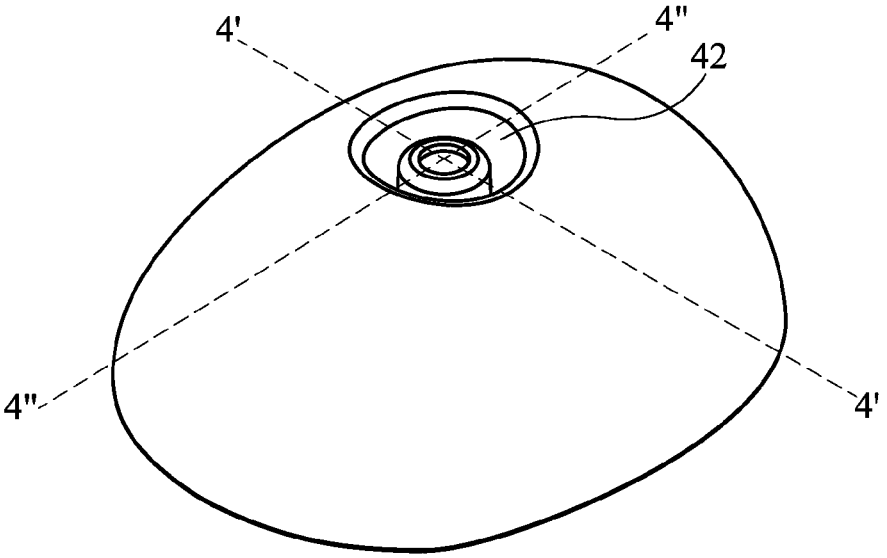
FIG. 4A is a top side perspective view of the dome.
Figure 4B:
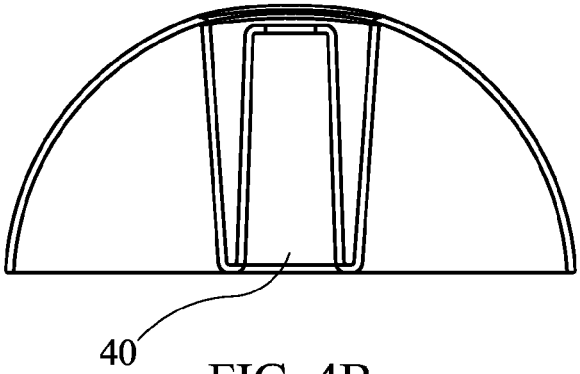
FIG. 4B is a cross-sectional view of the dome, taken across line 4'-4'.
Figure 4C:
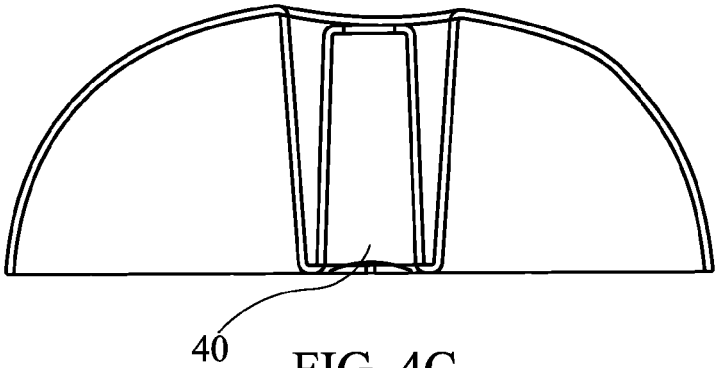
FIG. 4C is a cross-sectional view of the dome, taken across line 4"-4"

FIG. 3 shows that base 11 has a anchoring stud 30 secured to its center which serves to hold dome 14 when the device is disassembled and which serves to hold the bottom-most dowel when assembled. Stud 30 is inserted into channel 40 which is located in the central portion of the underside of dome 14 as shown in FIGS. 4B and 4C.

Figure 5A:
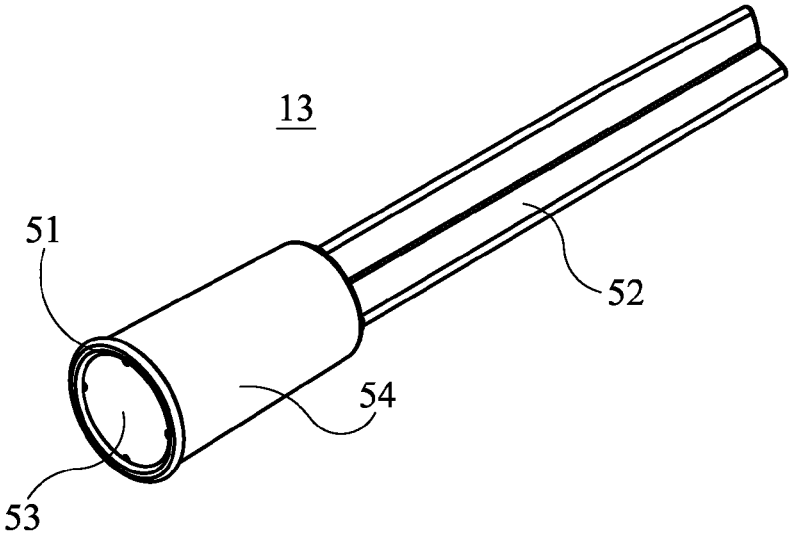
FIG. 5A is a perspective view of a dowel.
Figure 5B:
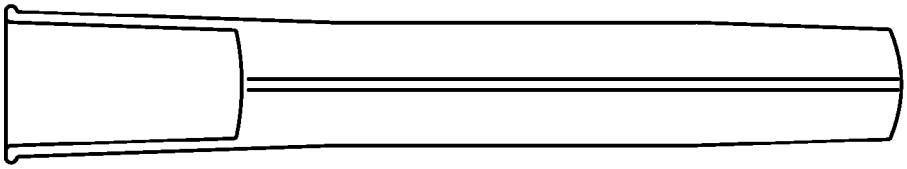
FIG. 5B is an elevation view of same.
Figure 5C:
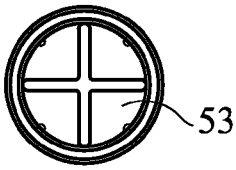
FIG. 5C is a bottom plan view of same.
Figure 5D:
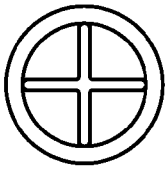
FIG. 5D is a top plan view of same.

Dowel 13 is shown in FIGS. 5A and 5B and consists of a collar 51 with an opening 53 at one end (shown in FIG. 5C) and a t-section 52 at the other (shown in FIG. 5D). Opening 53 is configured to receive t-section 52 of another dowel 13 or anchoring stud 30.

Device 10 is assembled by attaching dowel 13 to base 11 by fitting opening 53 over stud 30. Additional dowels 13 are stacked sequentially onto previous installed dowels 13 by fitting opening 53 over t-section 52 until the desired height is reached, either sufficient to accommodate the length of the wig or for display purposes. Dome 14 is then attached to the topmost dowel. Disassembly is accomplished in the reverse order. Dowels 13 can be stored in indentations 12 and dome 14 is secured over dowels by inserting stud 30 into channel 40, thus maintaining dowels 13 in position in indentations 12.

Figure 6A:
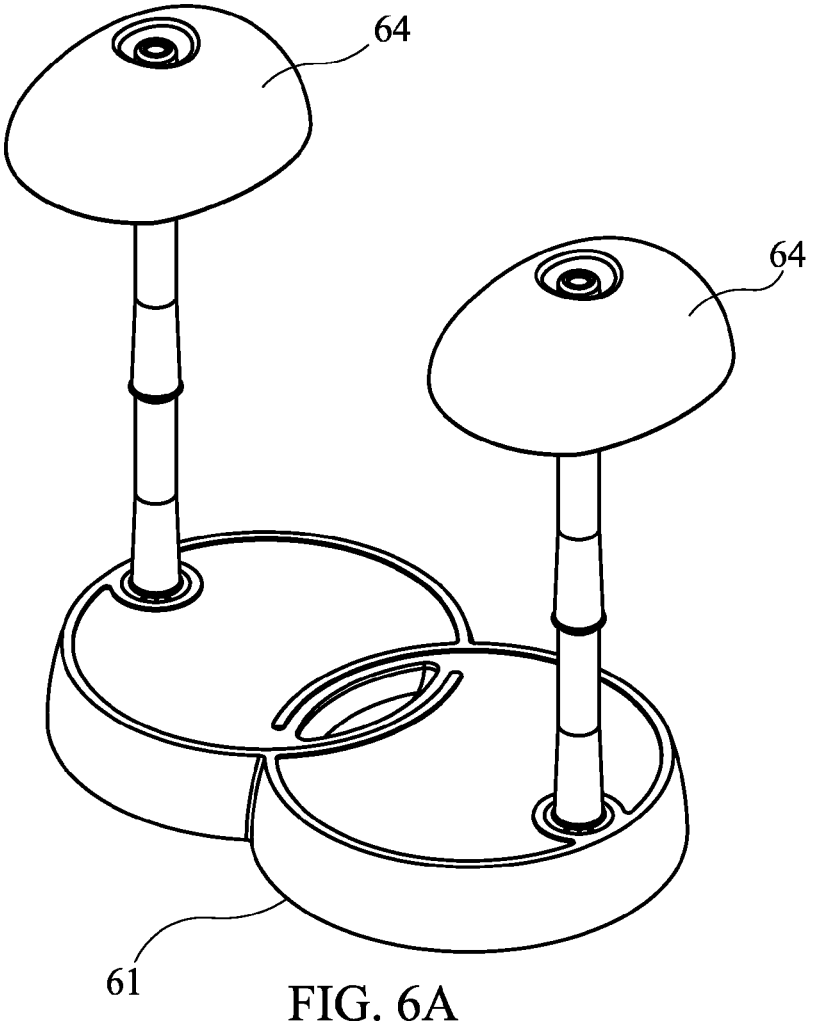
FIG. 6A is a perspective view of a bi-head embodiment of the present invention, as assembled.
Figure 6B:
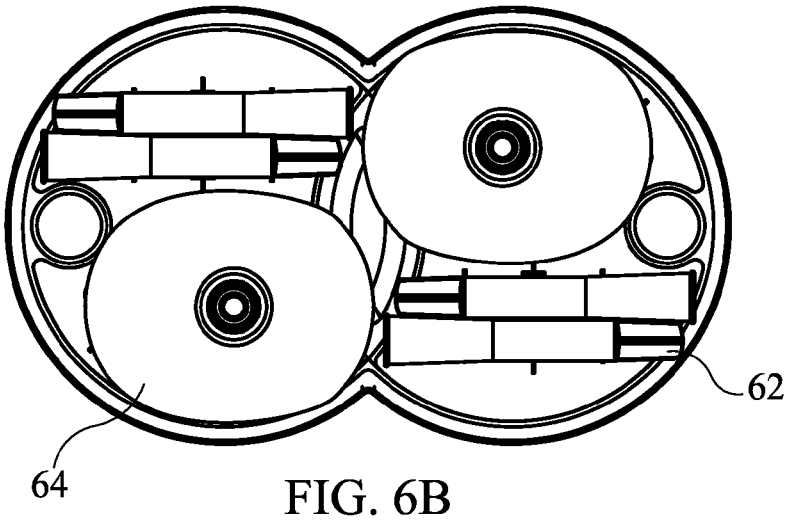
FIG. 6B is a bottom view of same, with domes and dowels in storage position.

The inventive device may be configured to accommodate one or more wigs. FIGS. 6A, 7C, and 7D show embodiments of the assembled inventive device capable of holding two or three wigs. In these embodiments, indentations for holding dowels and cavities for holding domes are configured on the bottom of bases 61 or 71 and dowels and domes can be stored therein, as shown in FIGS. 6D and 7E. Domes 64 and 74 are retained in place while in storage, e.g., by fitting channels 40 onto a stud 30 extending out of bases 61 and 71

Figure 6C:
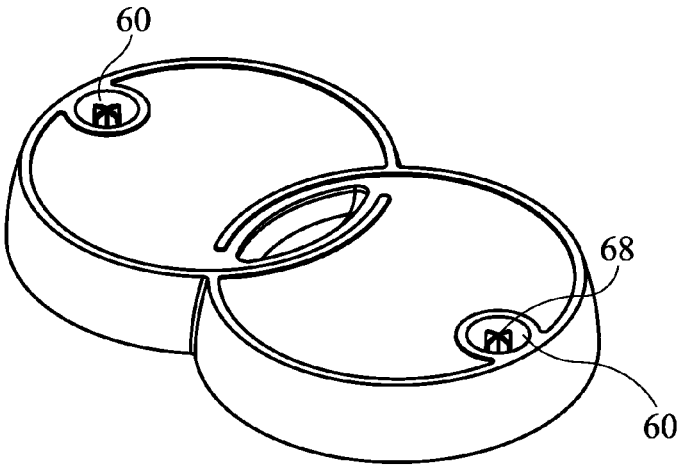
FIG. 6C is a top perspective view of the base of same.
Figure 7A:
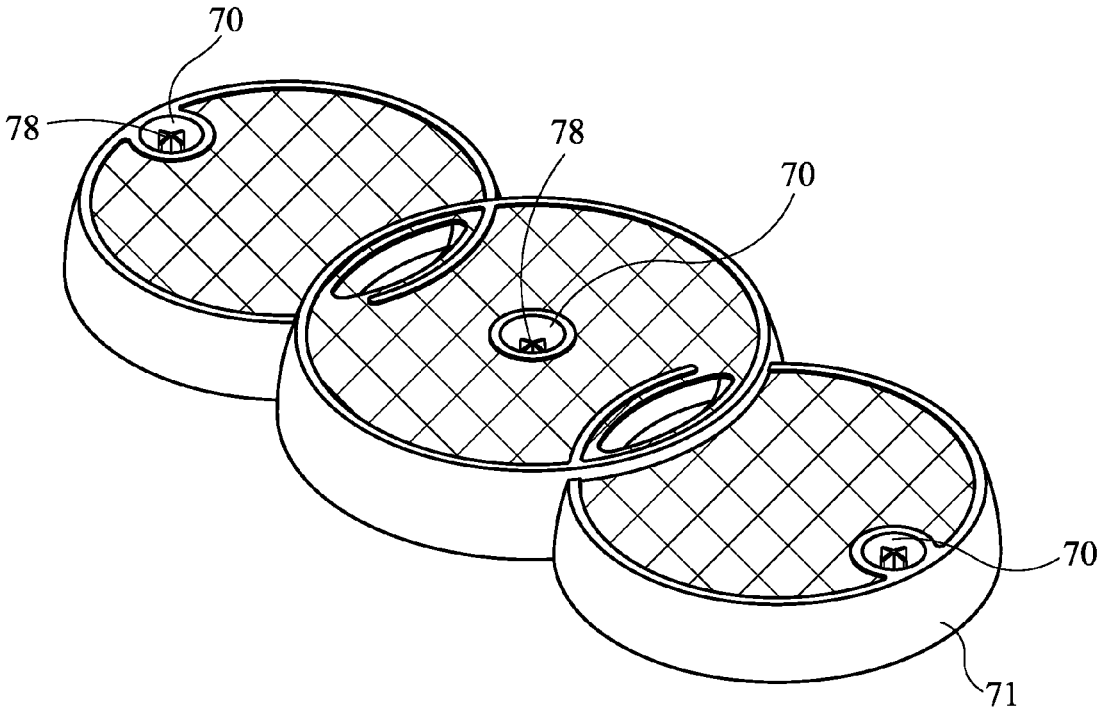
FIG. 7A is a top perspective view of the base of a tri-head embodiment of the present invention.
Figure 7B:
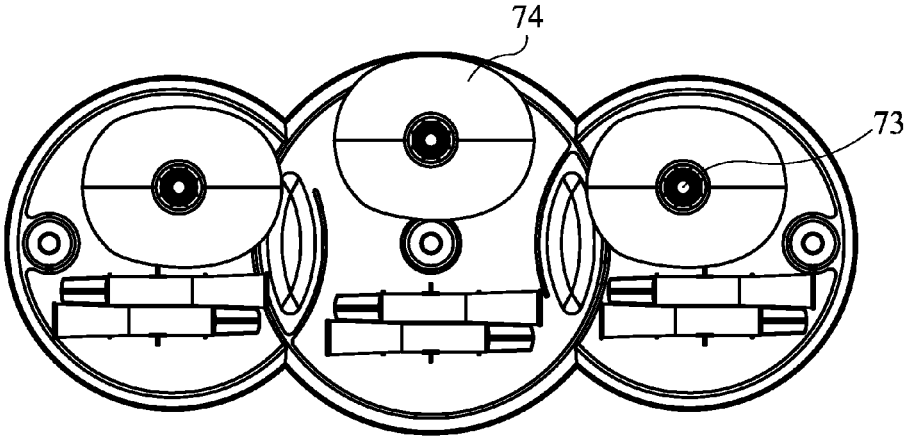
FIG. 7B is a plan view of the bottom of same, with domes and dowels stored therein.
Figure 7C:
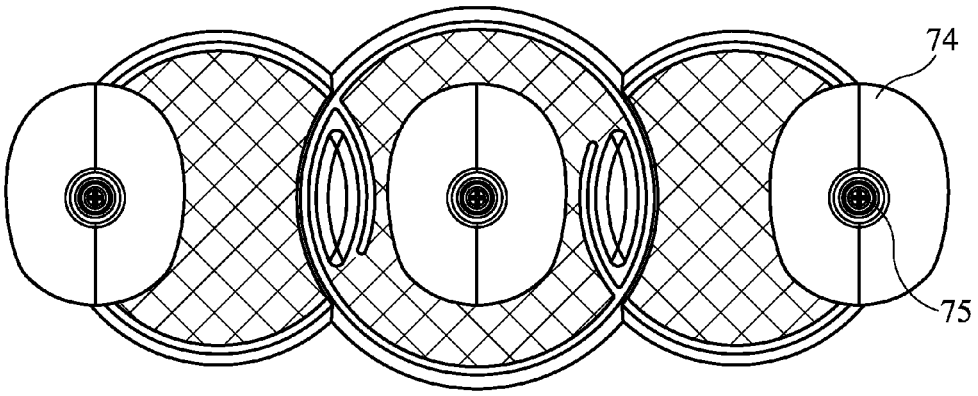
FIG. 7C is a top plan view of same, as assembled.
Figure 7D:
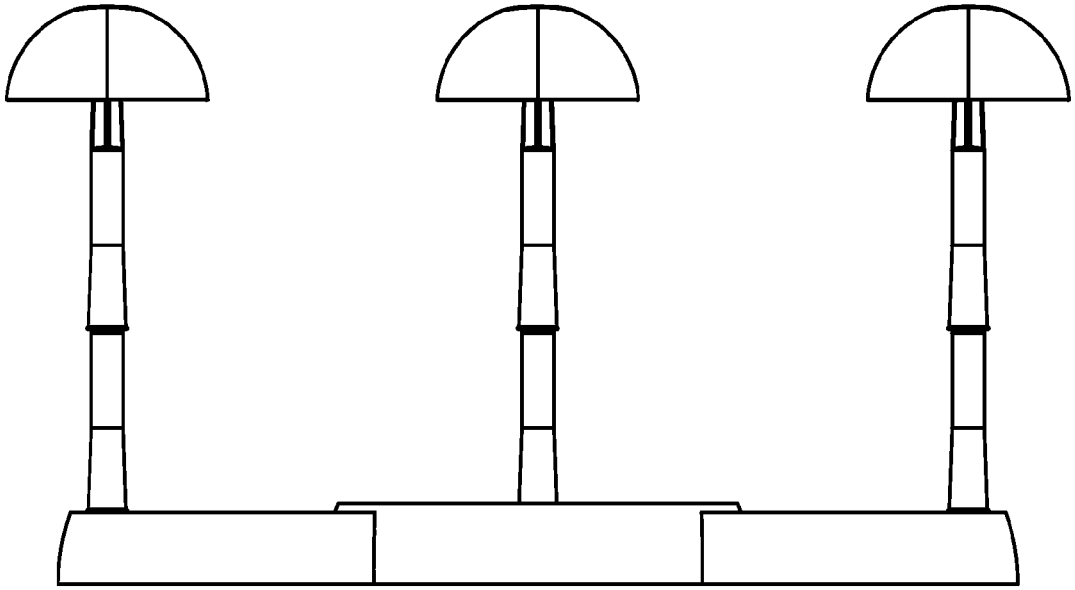
FIG. 7D is a side elevation view of same, as assembled.

Holes 60 and 70, as shown in FIGS. 6C and 7A, are configured to receive dowels 13. Holes 60 and 70 contain structures 68 and 78, respectively, capable of engaging with opening 53 and securing dowel 13.

Storeable domes 14 and 64 may be replaced when desired by a standard styrofoam head. The unihead embodiment will be lighter than the duohead or trihead embodiment, and thus will be more appropriate in many cases for traveling.

The invention claimed is:

1. A stand for holding at least one wig comprising:

a. a base having a plurality of indentations which are elongated horizontally in the base;

b. a support located on a top portion of the base, which support has a connecting tip extending upwardly vertically from the base;

c. a first dowel which can fit lengthwise within one of the elongated indentations, which dowel has a first end that engages with the connecting tip of the support and a second end that has a configuration similar to the connecting tip; and d. a dome having a central portion with a channel therein, which channel engages with the second end of the dowel.

2. A stand according to claim 1 further comprising a plurality of additional dowels identical to the first dowel wherein the dowels can be sequentially connected one on top of another, increasing the stand's height.

3. A stand according to claim 2 wherein the dowels all fit lengthwise within the elongated indentations.

4. A stand according to claim 3 wherein the plurality of elongated indentations is located on the top portion of the base.

5. A stand according to claim 4 wherein the dowels are placed lengthwise within the elongated indentations and the channel in the dome is fit onto the connecting tip of the support.

6. A stand for holding at least one wig comprising:

a. a base having a top portion with at least one hole in the top portion;

b. a plurality of indentations on the base which are elongated horizontally in the base;

c. at least one dowel which can fit lengthwise within one of the elongated indentations, which dowel has a first end that fits within the hole on the top portion of the base and a second end that has a connecting tip; and d. a dome having a central portion with a channel therein, which channel engages with the connecting tip on the second end of the dowel.

7. A stand according to claim 6 further comprising a plurality of additional dowels identical to the first dowel wherein the dowels can be sequentially connected one on top of another, increasing the stand's height.

8. A stand according to claim 6 wherein the dowels all fit lengthwise within the elongated indentations.

9. A stand according to claim 8 wherein the plurality of elongated indentations is located on the bottom portion of the base.

10. A stand according to claim 9 wherein the dowels are placed lengthwise within the elongated indentations.

11. A stand according to claim 9 further comprising an area shaped to accommodate the dome where the channel in the dome engages a structure extending from the base.

* * * * *